US012727694B2

(12) United States Patent
Young

(10) Patent No.: US 12,727,694 B2
(45) Date of Patent: Sep. 8, 2026

(54) CONCAVE RING COASTER

(71) Applicant: Steven Young, Liberal, KS (US)

(72) Inventor: Steven Young, Liberal, KS (US)

( * ) Notice: Subject to any disclaimer, the term of this patent is extended or adjusted under 35 U.S.C. 154(b) by 0 days.

(21) Appl. No.: 18/824,011

(22) Filed: Sep. 4, 2024

(65) Prior Publication Data

US 2026/0060463 A1 Mar. 5, 2026

(51) Int. Cl.
*A47G 23/00* (2006.01)
*A47G 23/03* (2006.01)

(52) U.S. Cl.
CPC ..... *A47G 23/03* (2013.01)

(58) Field of Classification Search
None
See application file for complete search history.

(56) References Cited

U.S. PATENT DOCUMENTS 1,981,627 A * 11/1934 Merriman ..... A47G 23/03 248/346.11
2,601,312 A * 6/1952 Mcgrew ..... A47G 23/03 248/346.11
2,766,796 A * 10/1956 Tupper ..... A47G 23/03 220/523
3,268,198 A * 8/1966 Swett ..... A47G 19/2283 248/346.11
4,336,574 A * 6/1982 Goodman ..... A47G 23/0309 248/346.11
5,018,695 A * 5/1991 Bishop ..... B32B 7/02 248/346.11
5,273,182 A * 12/1993 Laybourne ..... A47G 23/03 248/346.11
2002/0134903 A1* 9/2002 Lin ..... A47G 19/2261 248/346.11
2011/0290976 A1* 12/2011 Kraus, Jr. ..... A47G 23/03 248/346.11
2018/0368601 A1* 12/2018 Masanek, Jr. ..... B29C 45/0001
2024/0066372 A1* 2/2024 Paul ..... A63B 67/06
2025/0176746 A1* 6/2025 Lazor ..... A47G 23/03

FOREIGN PATENT DOCUMENTS

GB 2297476 A * 8/1996 ..... A47G 23/03

* cited by examiner

*Primary Examiner* — Steven M Marsh
(74) *Attorney, Agent, or Firm* — Lyman Moulton, Esq.; Moulton Patents, PLLC

(57) ABSTRACT

A drinking glass coaster has a circular substrate with a flat topside and a concave underside having a perimeter lip configured to make contact with a table top and at least one concentric ring attached to the concave underside and the flat topside and comprising a reusable sticky substance for adhering to a bottom of a drinking glass.

14 Claims, 8 Drawing Sheets

CONCAVE RING COASTER

SUMMARY OF THE INVENTION

A drinking glass coaster having a circular substrate with a flat topside and a concave underside having a perimeter lip configured to make contact with a table top and at least one concentric ring attached to the flat topside and comprising a reusable sticky substance for adhering to a bottom of a drinking glass.

Figure 1:
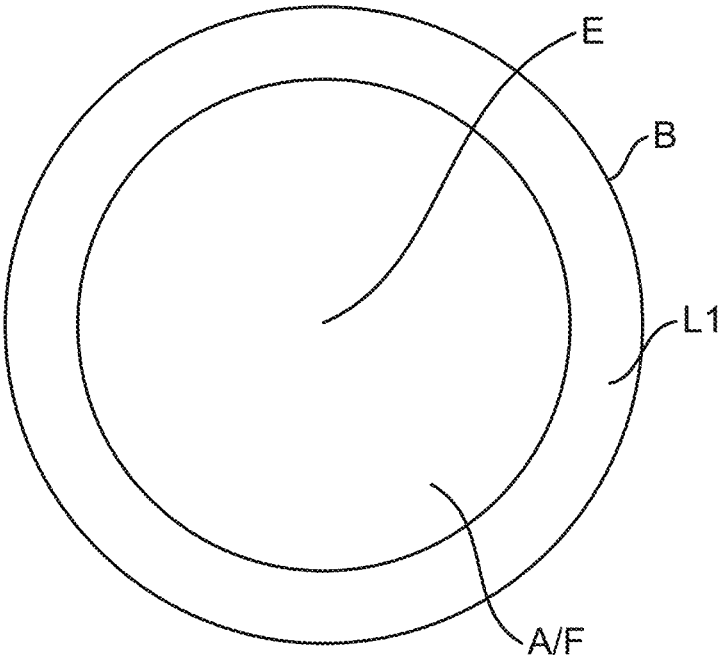
FIG. 1 is a top perspective view of the concave ring coaster in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a top view of the concave ring coaster in accordance with an embodiment of the present disclosure. The view includes the lip L1, the circular substrate A and flat ring B, the circular substrate center E and the reusable sticky substance F on the topside of the circular substrate A.

Figure 2:
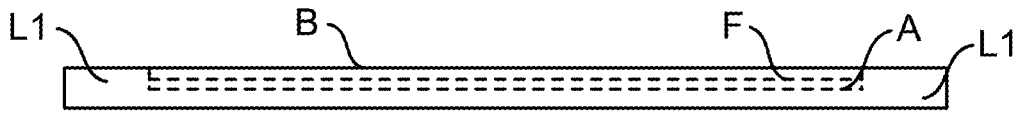
FIG. 2 is a side elevational view of a single concave ring coaster in accordance with an embodiment of the present disclosure.

FIG. 2 is a side elevational view of the concave ring coaster in accordance with an embodiment of the present disclosure. The view includes the lip L1 which circles a perimeter of the circular substrate A, the reusable sticky substance F on the topside of the circular substrate A and the flat ring B defining a concave and concentric center extending out therefrom to the perimeter ring L1.

Figure 3:
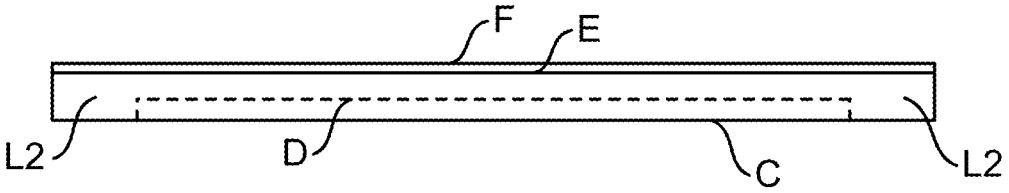
FIG. 3 is a side elevational view of a double concave ring coaster in accordance with an embodiment of the present disclosure.

FIG. 3 is a side elevational view of a flipped single concave ring coaster in accordance with an embodiment of the present disclosure. The flat ring C has a concave underside D, topside E and perimeter lip L2 configured to make contact with a table top and at least one concentric ring B. The circular substrate A is coated on the topside with a reusable sticky substance F for adhering to a bottom of a drinking glass in an inverted position with respect to flat ring B.

Figure 4:
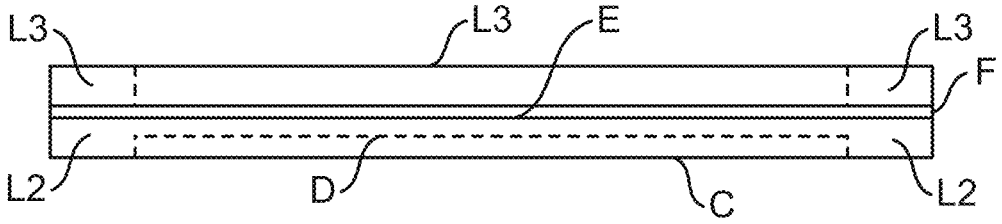
FIG. 4 is a side elevational view of a single concave ring coaster with a top side flat retaining ring in accordance with an embodiment of the present disclosure.

FIG. 4 is a side elevational view of a single concave ring coaster with a topside flat retaining ring in accordance with an embodiment of the present disclosure. The view includes all the physical features, reference characters and reference lines of FIG. 3 with the addition of a second flat ring L3 which sticks to the circular substrate A via the reusable sticky substance F to provide a retaining concentric ring for condensation from the drinking glass held thereon.

Figure 5:
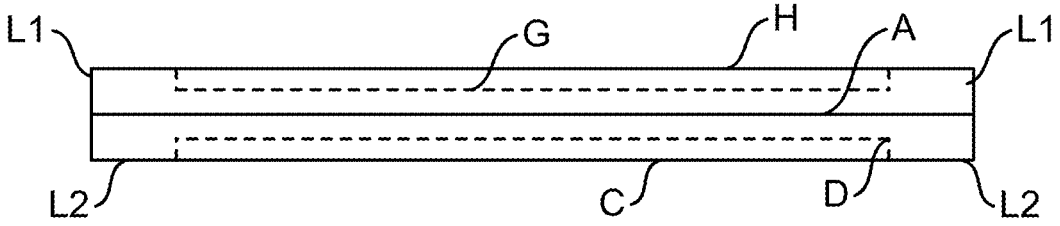
FIG. 5 is a top view of the concave ring coaster in accordance with an embodiment of the present disclosure.

FIG. 5 is a side elevational view of a double concave ring coaster in accordance with an embodiment of the present disclosure. The view includes all physical features, reference characters and reference lines of FIG. 3 and additionally the flat ring H with perimeter lip L1 and concavity G. Therefore, the double concave ring coaster of the present figure is equivalent to two each single concave ring coasters stuck together on respective topsides.

Figure 6:
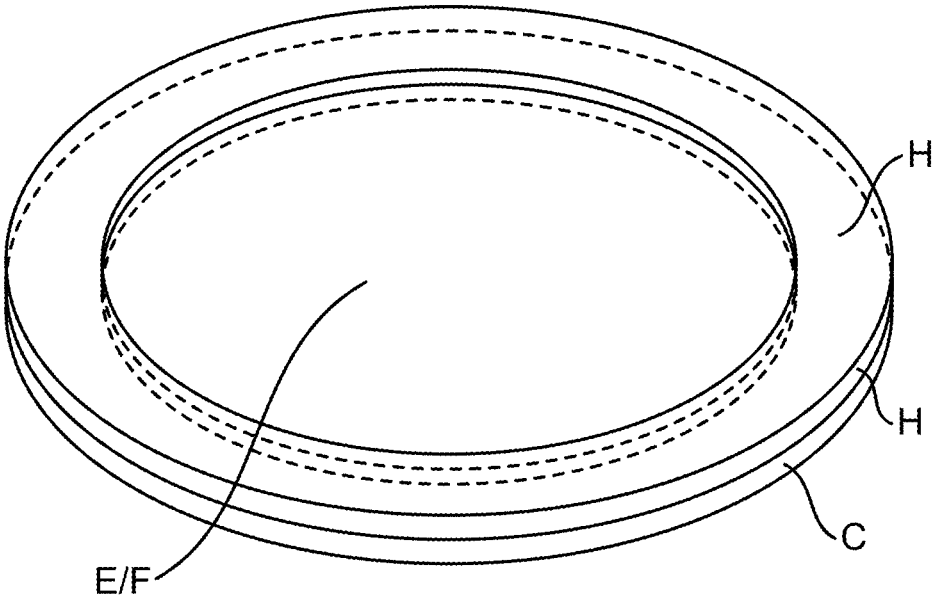
FIG. 6 is a bottom view of the concave ring coaster with radial grooves in accordance with an embodiment of the present disclosure.

FIG. 6 is a top perspective view of the double concave ring coaster in accordance with an embodiment of the present disclosure. The circular substrate E supports the rings H and C. The view includes the flat rings H and C and center space for catching condensed moisture coming off a drinking glass in contact with the disclosed coaster. The circular substrate E is covered with a reusable sticky material or substance F designed to firmly hold onto a bottom of a drinking glass but yet be removed for washing.

Figure 7:
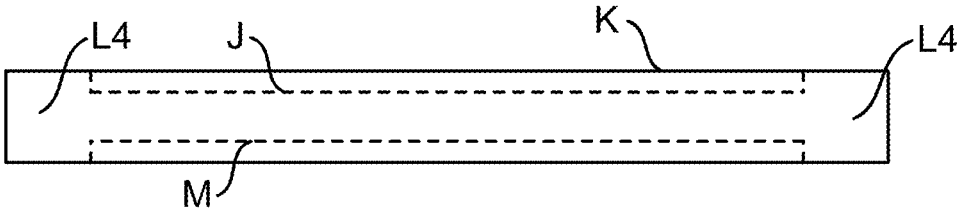
FIG. 7 is a side elevational view of a one piece double concave ring coaster in accordance with an embodiment of the present disclosure.

FIG. 7 is a side elevational view of a one piece double concave ring coaster in accordance with an embodiment of the present disclosure. The flat ring K is one piece circular substrate and two flat concentric rings and a topside concavity J and a bottom or underside concavity M and perimeter ring L4. with the circular substrate in embodiments. Other embodiments include a single circular substrate A and some embodiments have a single perimeter ring B. Some embodiments have several rings with different topside configurations including flat, bumpy, grainy and crenulated.

Figure 8:
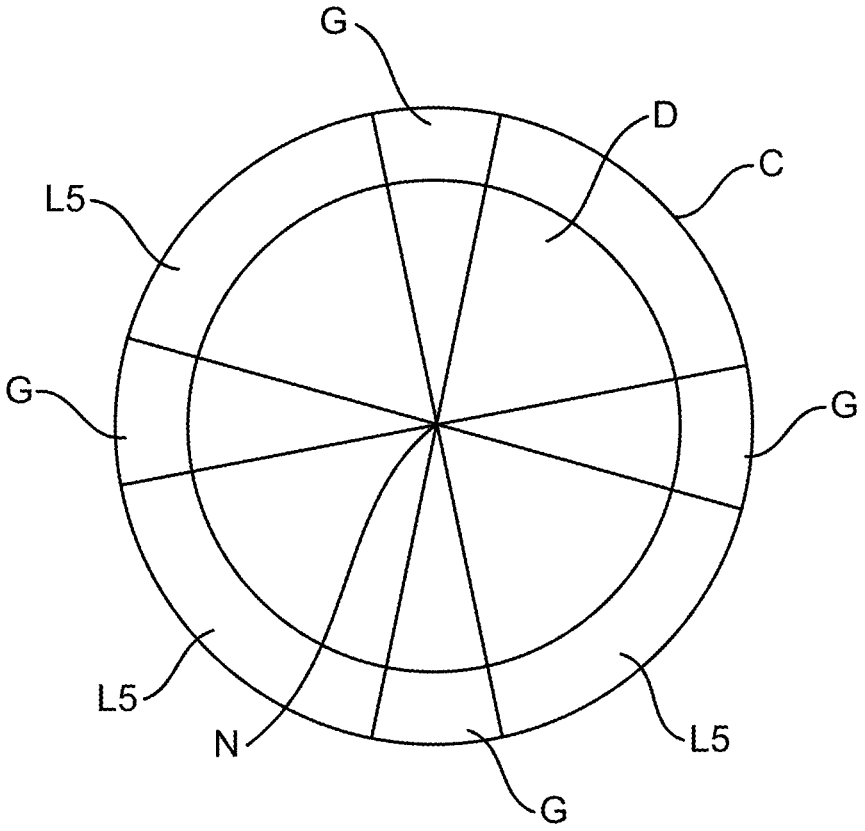
FIG. 8 is a bottom view of the concave ring coaster with radial grooves in accordance with an embodiment of the present disclosure.

FIG. 8 is a bottom view of the concave ring coaster with radial grooves in accordance with an embodiment of the present disclosure. The view includes the top ring C, the circular concavity D, center N, grooves G and legs from perimeter L5 (no longer continuous) in the underside for air escape when the disclosed coaster is placed on a smooth tabletop surface.

The main purpose of the Sticky Ring is to provide users with a coaster that eliminates the hassle of remembering where to place a protective base to shield surfaces from water damage. Traditional coasters often get misplaced or forgotten, as a person places their drink down on tables, countertops, sidebars, and other furniture items, which can lead to water stains and potential damage to said surfaces. The water stains from the condensation on beverage containers, glasses, or beer bottles tend to be unrepairable leaving unsightly stains on quality items.

Ingenious and practical, the Sticky Ring offers a modern coaster design that attaches directly to a beverage container ensuring that wherever the drink goes, the coaster goes with it; thereby, eliminating the need to constantly search for or remember to position a protective barrier between a drink and a furniture piece. Expanding on the initial design of a coaster, the Sticky Ring introduces a novel and strong adhesive center of the coaster that securely attaches to any beverage container, including cups, cans, and bottles, to prevent water damage to surfaces. The adhesive ring securely holds the coaster in place, preventing any moisture from seeping onto the surface below.

To prevent the coaster from sticking to the surface of the table, this avant-garde product features the option of legs, a small lip around the adhesive ring that extends outward, or a concave alternative. This design feature enhances stability while still allowing for easy attachment and removal of the coaster, at the user's preference.

To further enhance functionality, on the opposite side of the adhesive ring, or on a second ring underneath a top or first ring, a ceramic coating or other heat-regulating material helps maintain the temperature of heated beverages such as coffee or tea, ensuring that a drink stays warm for a longer time. The adhesive ring, universal shape, and protective ceramic coating of the Sticky Ring provides a hassle-free way to enjoy beverages without worrying about permanent furniture water damage or misplaced coasters; thus, it may prove to be essential in the household/novelty industry.

The Sticky Ring is the only product of its kind that provides a coaster able to stick directly onto a beverage as well as keep a drink at its ideal temperature, at all times. This unprecedented product is uniquely designed with a universal shape to fit a variety of beverage containers, including square, circle, hexagon, or triangle shapes. This versatility ensures that the coaster can accommodate diverse drinking vessels and the Sticky Ring is carefully crafted with a durable adhesive that is reusable and waterproof, ensuring long-lasting durability and easy cleaning.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A drinking glass coaster comprising:

a circular substrate having a concave underside and a flat topside comprising a reusable sticky substance for adhering to a bottom of a drinking glass;

at least one concentric ring defined by the concave underside and comprising a perimeter lip configured to make contact with a table top; and a plurality of radial grooves defined in the concave underside and the at least one concentric ring configured for an air escape therefrom a placement of the drinking glass coaster on a smooth table top.

2. The drinking glass coaster of claim 1, wherein the underside is concave from the perimeter lip to a center of the circular substrate.

3. The drinking glass coaster of claim 1, further comprising a discrete second concentric ring temporarily attached to the flat topside of the circular substrate via the reusable sticky substance.

4. The drinking glass coaster of claim 1, wherein the at least one concentric ring is shaped like a flat ring washer.

5. The drinking glass coaster of claim 1, wherein the at least one concentric ring defines an outside perimeter edge coincident with a perimeter edge of the circular substrate.

6. The drinking glass coaster of claim 1, further defining a second concentric ring comprising an outside perimeter edge coincident with a perimeter edge of the circular substrate.

7. The drinking glass coaster of claim 1, wherein the at least one concentric ring has a low durometer in relation to a stiffness of the circular substrate.

8. The drinking glass coaster of claim 1, wherein the at least one concentric ring is soft in relation to a stiffness of the circular substrate.

9. The drinking glass coaster of claim 1, wherein the circular substrate and the at least one concentric ring comprise the same material.

10. The drinking glass coaster of claim 1, wherein the circular substrate and the at least one concentric ring comprise a single piece.

11. The drinking glass coaster of claim 1, wherein the circular substrate and the at least one concentric ring comprise a single piece having a low durometer, or a floppy behavior.

12. The drinking glass coaster of claim 1, wherein the reusable sticky substance covers the at least one concentric ring.

13. The drinking glass coaster of claim 1, further comprising the concave underside in relation to the table top to provide an air insulation to temperature gradients of a fluid in the drinking glass.

14. The drinking glass coaster of claim 1, wherein the perimeter lip comprises a ceramic insulating material configured to provide an insulation to temperature gradients of a fluid in the drinking glass.

* * * * *